US011085717B1

(12) United States Patent
Hillis et al.

(10) Patent No.: US 11,085,717 B1
(45) Date of Patent: Aug. 10, 2021

(54) MAGAZINE EXTENSION FOR A FIREARM

(71) Applicant: JAGEMANN PRECISION PLASTICS, INC., Murfreesboro, TN (US)

(72) Inventors: Mark Hillis, Murfreesboro, TN (US); Kirk McDonald, Murfreesboro, TN (US)

(73) Assignee: JAGEMANN PRECISION PLASTICS, INC., Murfreesboro, TN (US)

( * ) Notice: Subject to any disclaimer, the term of this patent is extended or adjusted under 35 U.S.C. 154(b) by 0 days.

(21) Appl. No.: 17/080,679

(22) Filed: Oct. 26, 2020

Related U.S. Application Data

(63) Continuation of application No. 16/932,739, filed on Jul. 18, 2020, now Pat. No. 10,852,086.

(51) Int. Cl.
*F41A 9/71* (2006.01)

(52) U.S. Cl.
CPC ..... *F41A 9/71* (2013.01)

(58) Field of Classification Search
CPC ..... F41A 9/65; F41A 9/71
See application file for complete search history.

(56) References Cited

U.S. PATENT DOCUMENTS 4,862,619 A * 9/1989 Baldus ..... F41A 9/71 42/7
5,081,778 A 1/1992 Switzer ..... F41A 9/66 42/50
5,642,582 A 7/1997 Grams ..... F41A 9/65 42/50
5,666,752 A 9/1997 Grams ..... F41A 9/71 42/49.02
6,557,287 B2 * 5/2003 Wollmann ..... F41A 9/65 42/50
7,117,622 B2 10/2006 Freed ..... F41A 9/65 42/7
9,267,749 B1 * 2/2016 Dukart ..... F41A 9/70
9,945,627 B2 * 4/2018 Porat ..... F41A 9/65
10,048,030 B2 * 8/2018 Corso ..... F41A 9/65
10,190,835 B2 * 1/2019 Hsu ..... F41A 9/71
(Continued)

FOREIGN PATENT DOCUMENTS

WO WO-2020123390 A1 * 6/2020 ..... F41A 9/66

*Primary Examiner* — Joshua T Semick
(74) *Attorney, Agent, or Firm* — Eric B. Fugett; Mark A. Pitchford; Pitchford Fugett, PLLC

(57) ABSTRACT

A magazine extension comprises an extension body having an open upper end configured to be slidably coupled with an open bottom end of a magazine tube for an ammunition magazine, a retaining member, and a base plate. The retaining member is removably receivable in a passage defined through a rear wall of the extension body to releasably secure the body to the magazine tube. A portion of the retaining member protrudes out of an upper end of the passage and overlaps a rear wall of the magazine tube to limit sliding movement of the tube relative to the extension body when the tube is coupled with the body and the retaining member is received in the passage. The base plate is configured to be slidably coupled with an open lower end of the extension body and obstruct a lower end of the passage to releasably secure the retaining member in the passage.

20 Claims, 7 Drawing Sheets

(56) References Cited

U.S. PATENT DOCUMENTS

| | | | | |
|---|---|---|---|---|
| 10,317,153 | B2 | 6/2019 | Faifer | F41A 9/71 |
| 10,480,880 | B2 * | 11/2019 | Thomele | F41A 9/69 |
| 10,852,086 | B1 * | 12/2020 | Hillis | F41A 9/71 |
| 10,996,010 | B2 * | 5/2021 | Cass | F41A 9/71 |
| 2017/0321979 | A1 * | 11/2017 | Szczepkowski | F41A 9/71 |
| 2020/0064092 | A1 | 2/2020 | Pini | F41A 9/65 |
| 2020/0103189 | A1 | 4/2020 | Cass | F41A 9/71 |
| 2020/0208929 | A1 | 7/2020 | Corso | F41A 11/00 |
| 2020/0348094 | A1 * | 11/2020 | Lee | F41A 9/71 |

* cited by examiner

MAGAZINE EXTENSION FOR A FIREARM

CROSS-REFERENCES TO RELATED APPLICATIONS

This application is a continuation of U.S. patent application Ser. No. 16/932,739, filed Jul. 18, 2020 and titled "MAGAZINE EXTENSION FOR A FIREARM," which issued as U.S. Pat. No. 10,852,086 on Dec. 1, 2020, the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to ammunition magazines for firearms, and more particularly, to magazine extensions for ammunition magazines.

Removable box-type ammunition magazines for modern rifles and handguns typically include a generally rectangular hollow body, commonly known as a magazine tube or body, with an open bottom end. A rim or flange typically extends laterally outward from two or three edges of the open bottom end. A floorplate is typically attached to the bottom end of the magazine tube by sliding the floorplate over the flanged rim. The floorplate is often held in place by a protrusion extending downwardly from a bottom surface of an internal plate member, commonly known as a spring seat, spring retainer, inner plate, or lock plate, which is biased against the floorplate by a magazine spring. Other mechanical locking means are also known to be used for holding the floorplate in place on the magazine tube. Such mechanical locking means are usually external.

Magazine extensions are commonly used in place of the native floorplate at the bottom end of many modern ammunition magazines to increase magazine capacity and provide an additional handgrip that extends beyond the grip of the firearm. This allows a user to better grasp the firearm and more easily and quickly remove and insert magazines into the firearm using gross motor skills. Many magazine extensions include an integral floor or bottom wall that defines with the forward, rear and side walls a cavity or interior space in which the lower end of a magazine spring is receivable. However, these types of magazine extensions typically only increase the ammunition capacity of the magazine tube to which they are attached by one or two rounds, which is viewed as insufficient by many firearms users.

Other larger capacity magazine extensions typically rely on one or more rods or pins, or even more complex assembly mechanisms, to interlock components and maintain them together in an assembled state. These types of magazine extensions include numerous small parts that can be dropped, misplaced, or lost, and typically require the use of tools for assembly and disassembly. Additionally, many of the parts which hold such magazine extensions together and secure them on the terminal end of a magazine tube are externally accessible. As a result, these parts can become easily bent, broken, or dislodged during normal use of a firearm.

Accordingly, what is needed are improvements in magazines extensions for firearms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The presently disclosed subject matter overcomes or minimizes some or all of the identified deficiencies of the prior art, as will become evident to those of ordinary skill in the art after a study of the information presented in this document.

The present invention provides a universal, easy-to-use, high capacity magazine extension with the fewest possible separable components. The magazine extension includes an internal locking mechanism that reduces the chances of any single component becoming damaged, dislodged, or lost during assembly, use, or disassembly. The magazine extension disclosed herein requires no tools to assemble or install, and has no externally releasable interlocking components. Nor are the interlocking components externally accessible when the magazine extension is installed on an ammunition magazine and received in a magazine well of a firearm.

Features of the present invention include a removable retaining member receivable in a passage defined through a rear wall of the extension body behind a rear wall of the magazine tube to which the extension body is attached. A tip portion of the retaining member extends through an upper end of the passage and overlaps the rear wall of the magazine tube to prevent sliding movement of the extension body relative to the magazine tube. This secures the extension body to the magazine tube. The tip portion of the retaining member which protrudes out of the passage is sized and shaped so as to be received in and thus hidden or covered by the magazine well of the firearm when the magazine extension is installed on an ammunition magazine and received in the magazine well of the firearm. This advantageously prevents the tip portion from becoming damaged or dislodged when the magazine extension is in use.

The present invention also features a removable base plate that is slidably engageable with a bottom end of the extension body. When the magazine extension is fully assembled and installed on a magazine tube, the base plate obstructs the lower end of the passage and thereby secures the retaining member in the passage. As such, the retaining member is not removable from the magazine extension upon the application of an external force. The base plate is easily removable from the extension body to allow insertion or removal of the follower, magazine spring, and lock plate without disassembly of the extension body from the magazine tube. This allows easy installation of the magazine extension on the magazine tube without tools. It also allows removal of the follower, magazine spring, and lock plate for cleaning or maintaining the interior without disassembly of the extension body from the magazine tube.

One embodiment of the present invention also enables a user to retain and use the native spring seat or lock plate of the ammunition magazine on which the magazine extension is installed to secure the base plate onto the bottom end of the magazine extension in an easy and familiar manner. Another embodiment provides a lock plate size and shaped to be fit the ammunition magazine to which the magazine extension is to be attached.

Accordingly, in one aspect, the invention provides a magazine extension comprising an extension body having an open upper end configured to be slidably coupled with an open bottom end of a magazine tube for an ammunition magazine; a passage extending through a rear wall of the extension body; a retaining member removably receivable in the passage to releasably secure the extension body to the magazine tube; and a base plate configured to be slidably coupled with an open lower end of the extension body to releasably secure the retaining member in the passage.

In another aspect, the invention provides a magazine extension consisting of an extension body defining an interior space and an open upper end configured to be slidably coupled with an open bottom end of a magazine tube for an ammunition magazine; a passage defined through a rear wall of the extension body, the passage having an upper end which is spaced rearwardly from the interior space by a distance equal to or greater than a thickness of a rear wall of the magazine tube; a retaining member removably receivable in the passage, the retaining member having a tip portion which protrudes out of the upper end of the passage and overlaps the rear wall of the magazine tube to limit sliding movement of the magazine tube relative to the extension body and releasably secure the extension body to the magazine tube when the magazine tube is coupled with the extension body and the retaining member is received in the passage; and a base plate configured to be slidably coupled with an open lower end of the extension body such that the base plate obstructs a lower end of the passage to releasably secure the retaining member in the passage.

In yet another aspect, the invention provides a method for increasing the capacity of an ammunition magazine comprising providing a magazine extension disclosed herein; providing an ammunition magazine including a magazine tube, a follower, a spring, and a lock plate; coupling the bottom end of the magazine tube with the open upper end of the extension body; inserting the retaining member into the passage of the extension body; inserting the follower, spring, and lock plate into the magazine tube through the open lower end of the extension body; and coupling the base plate with the open lower end of the extension body.

In still yet another aspect, the invention provides an ammunition magazine for a firearm comprising a magazine tube defining a first interior space; an extension body defining a second interior space, the extension body having an open upper end with which a bottom end of the magazine tube is slidably coupled; a passage defined through a rear wall of the extension body, the passage having an upper end which is spaced rearwardly from the second interior space by a distance equal to or greater than a thickness of a rear wall of the magazine tube; a retaining member received in the passage; a base plate slidably coupled with a lower end of the extension body such that the base plate obstructs the lower end of the passage; a hole defined through the base plate; a follower received in the first interior space; a lock plate received in the second interior space, the lock plate having a downwardly extending protrusion formed on a lower surface thereof; and a spring received in the first and second interior spaces between the follower and an upper surface of the lock plate, the spring biasing the protrusion of the lock plate into the hole of the base plate; wherein a tip portion of the retaining member protrudes out of the upper end of the passage and overlaps the rear wall of the magazine tube to limit sliding movement of the magazine tube relative to the extension body and releasably secure the extension body to the magazine tube.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the portions relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The term "substantially" as used herein means within the limits of existing manufacturing limitations and tolerances.

Figure 1:
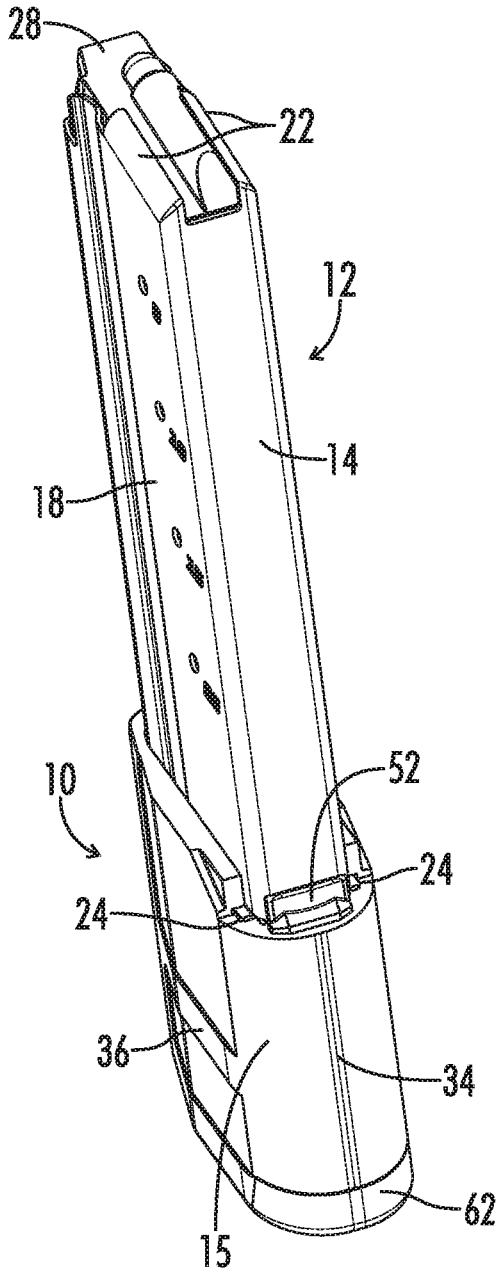
FIG. 1 is an elevated rear isometric view of a magazine extension for a firearm constructed in accordance with an embodiment of the present invention installed on a magazine tube for an ammunition magazine.
Figure 2:
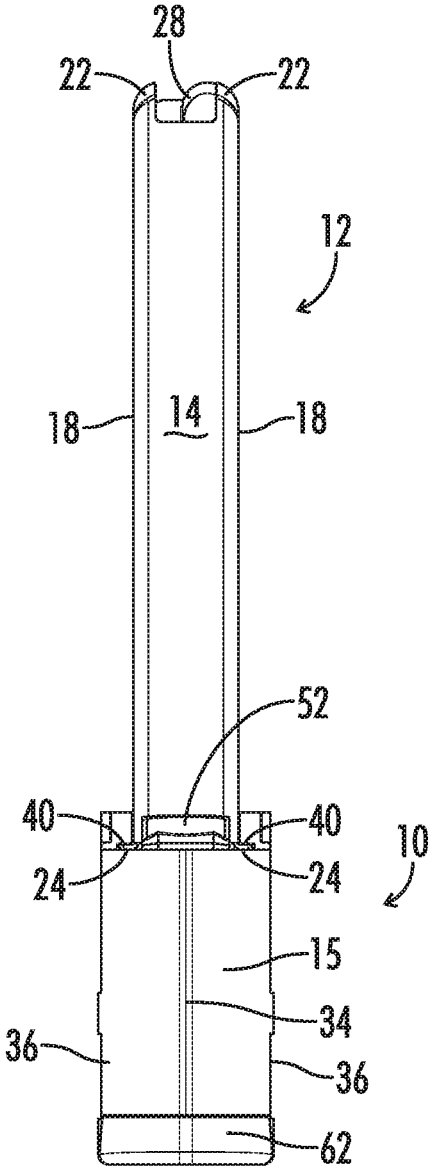
FIG. 2 is a rear elevational view of the objects of FIG. 1.
Figure 3:
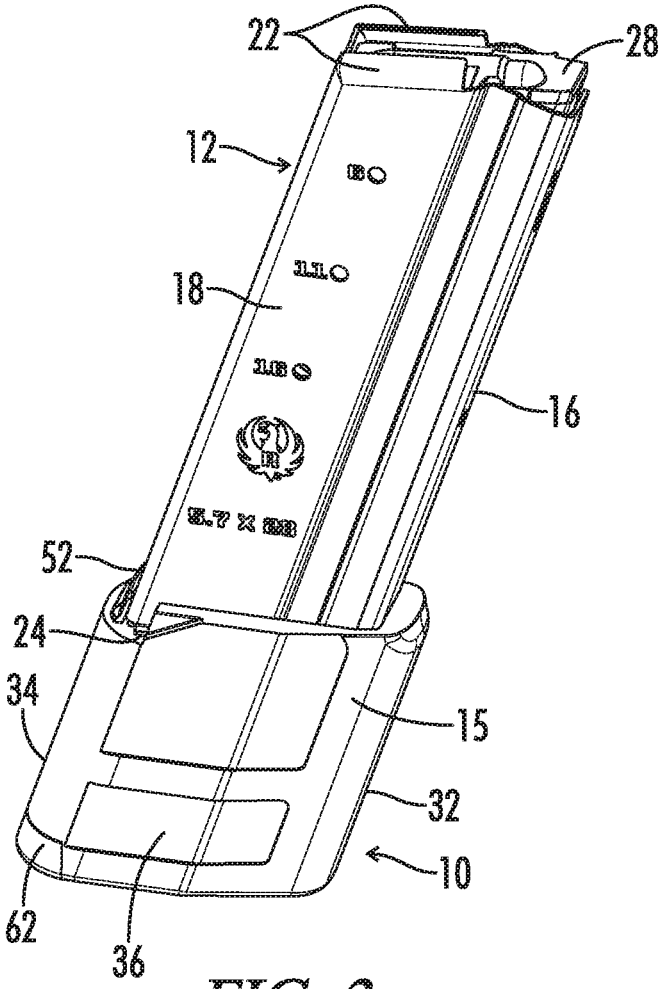
FIG. 3 is an elevated right-side isometric view of the objects of FIG. 1.
Figure 4:
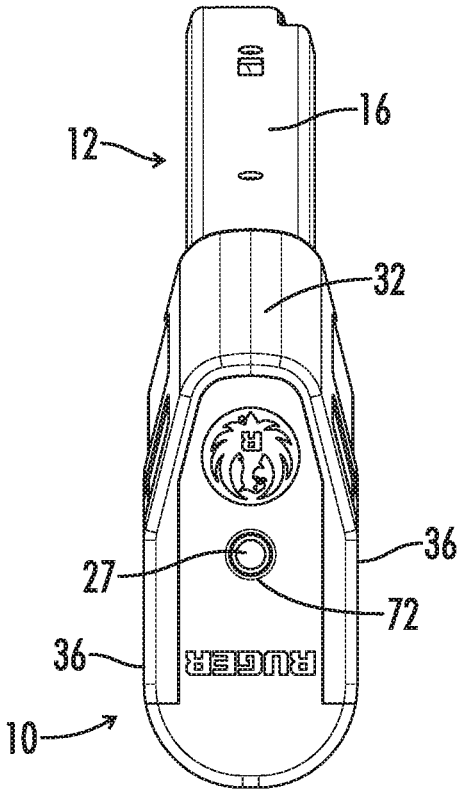
FIG. 4 is a bottom isometric view of the objects of FIG. 1.

This description and appended claims include the words "below", "above", "side", "top", "bottom", "upper", "lower", "when", "vertical", "horizontal", etc. to provide an orientation of embodiments of the invention to allow for proper description of example embodiments. The foregoing positional terms refer to the magazine extension when in an upright orientation as described herein, unless otherwise specified. An "upright" position of a magazine extension (and an ammunition magazine) is considered to be the position when held by a user in a generally vertical orientation as depicted in, for example, FIG. 1. "Forward" is generally the direction in which a projectile is propelled from a firearm in which an ammunition magazine to which the magazine extension is coupled is received in the firearm, and "rearward" is generally toward a user shooting the firearm.

Further, the terms "above", "below", "over", and "under" mean "having an elevation or vertical height greater or lesser than" and are not intended to imply that one object or component is directly over or under another object or component, unless otherwise specified. The term "when" is used to specify orientation for relative positions of components, not as a temporal limitation of the claims or apparatus described and claimed herein unless otherwise specified.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Referring now to FIGS. 1-10, a magazine extension 10 constructed according to an embodiment of the present invention is shown installed on a magazine body 12 for an ammunition magazine. The magazine body 12 shown is designed for use with a RUGER-57™ handgun (not shown). However, it is to be understood that embodiments of the invention can be adapted for use with other box-type magazines designed for other types and brands of pistols and rifles. The magazine body 12 is a generally elongated tube having a rear wall 14, a forward wall 16, and laterally spaced apart sidewalls 18, all of which define an interior space 20 in which a plurality of cartridges (not shown) for a firearm are receivable. The tube 12 has open top and bottom ends with a pair of spaced apart feed lips 22 at the top end for delivering a cartridge into the chamber of the firearm. The opposite bottom end can include a rim formed from one or more outwardly extending flanges 24. The flanges 24 typically extend laterally outward from the sidewalls 18, but can also extend from the forward wall 16 and/or the rear wall 14.

In ammunition magazines of this type, a standard magazine floorplate (not shown) includes a pair of grooves that will slide onto the flanges 24 and will remain secured by an internal magazine spring seat or lock plate member 26 which is biased into engaging position with a hole in the floorplate by an internal magazine spring 30. The upper surface of member 26 is typically designed to capture or seat a lower end of the magazine spring 30, while the lower surface of member 26 is typically formed with a downwardly extending protrusion 27 which engages a hole defined through the native floorplate to secure the floorplate to the bottom end of the magazine tube 12. The opposite upper end of the spring 30 is captured by or seated in a follower 28. The spring 30 presses against the lock plate 26 and biases the follower 26 toward the upper end of the magazine tube 12, pushing ammunition cartridges (not shown) received in the interior space 20 toward the feed lips 22.

According to an embodiment of the present invention, the standard floorplate is replaced with magazine extension 10, while the internal components native to the ammunition magazine, including the spring seat or lock plate 26, follower 28, and magazine spring 30 are retained. However, in some embodiments, replacement of the standard floorplate with a magazine extension 10 can include replacement of the original magazine spring 30 with a correspondingly longer and/or stronger spring. Those of skill in the art will recognize that the desirability of replacing the original magazine spring 30 with a longer and/or stronger spring will depend on the degree to which attachment of a magazine extension 10 to the magazine tube 12 increases the ammunition capacity of the magazine.

The magazine extension 10 provides a generally tubular extension of the magazine tube 12 with interior surfaces that generally correspond to and align with the interior surfaces of the rear wall 14, forward wall 16, and sidewalls 18 of the magazine tube 12. A typical handgun magazine tube 12 can have an open bottom end that is angled relative to the longitudinal axis of the of the magazine tube 12. This angle is due to handgun magazines typically being inserted into a magazine well located within a hand grip portion of the handgun, which is typically angled relative to vertical and not situated exactly perpendicular to the bore axis of the handgun barrel. The angled lower end of the magazine tube 12 allows it to conform to the angle at the heel end of the handgun grip where the magazine is inserted into the magazine well.

Referring again to FIGS. 1-10, the magazine extension 10 includes an extension body 15. The extension body 15 has a forward wall 32, a rear wall 34, and laterally spaced apart sidewalls 36 which correspond to the walls of the magazine tube 12 and provide corresponding interior surfaces that extend the interior space 20 of the magazine tube 12. In this way, the extension body 15 defines an interior space 38 in which the spring seat or lock plate 26, a lower end of the magazine spring 30, and a plurality of cartridges (not shown) are receivable. The extension body 15 also extends the longitudinal dimension of the magazine tube 12 in order to increase its ammunition holding capacity. In the embodiment depicted, the interior space 38 of the extension body 15 is sized and shaped to receive ten rounds of 5.7 mm ammunition. In other embodiments, the extension body 15 can be sized to accommodate fewer or a greater number of cartridges of the same or a different caliber. The interior space 38 defined by the extension body 15 is situated substantially below the interior space 20 defined by the magazine tube 12, as best shown in FIG. 5.

Figure 9:
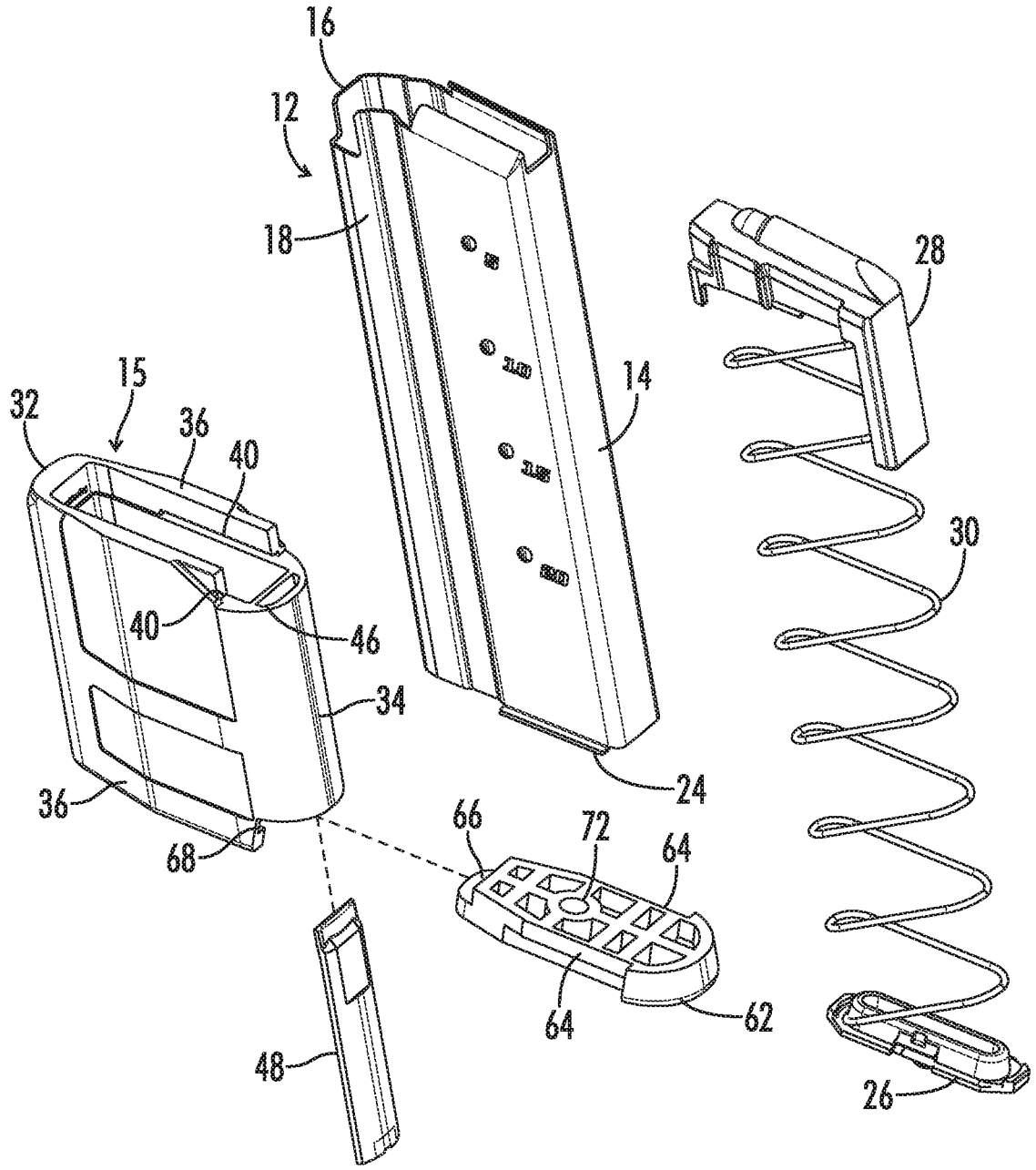
FIG. 9 is an elevated rear left-side exploded isometric view of the objects of FIG. 1.
Figure 10:
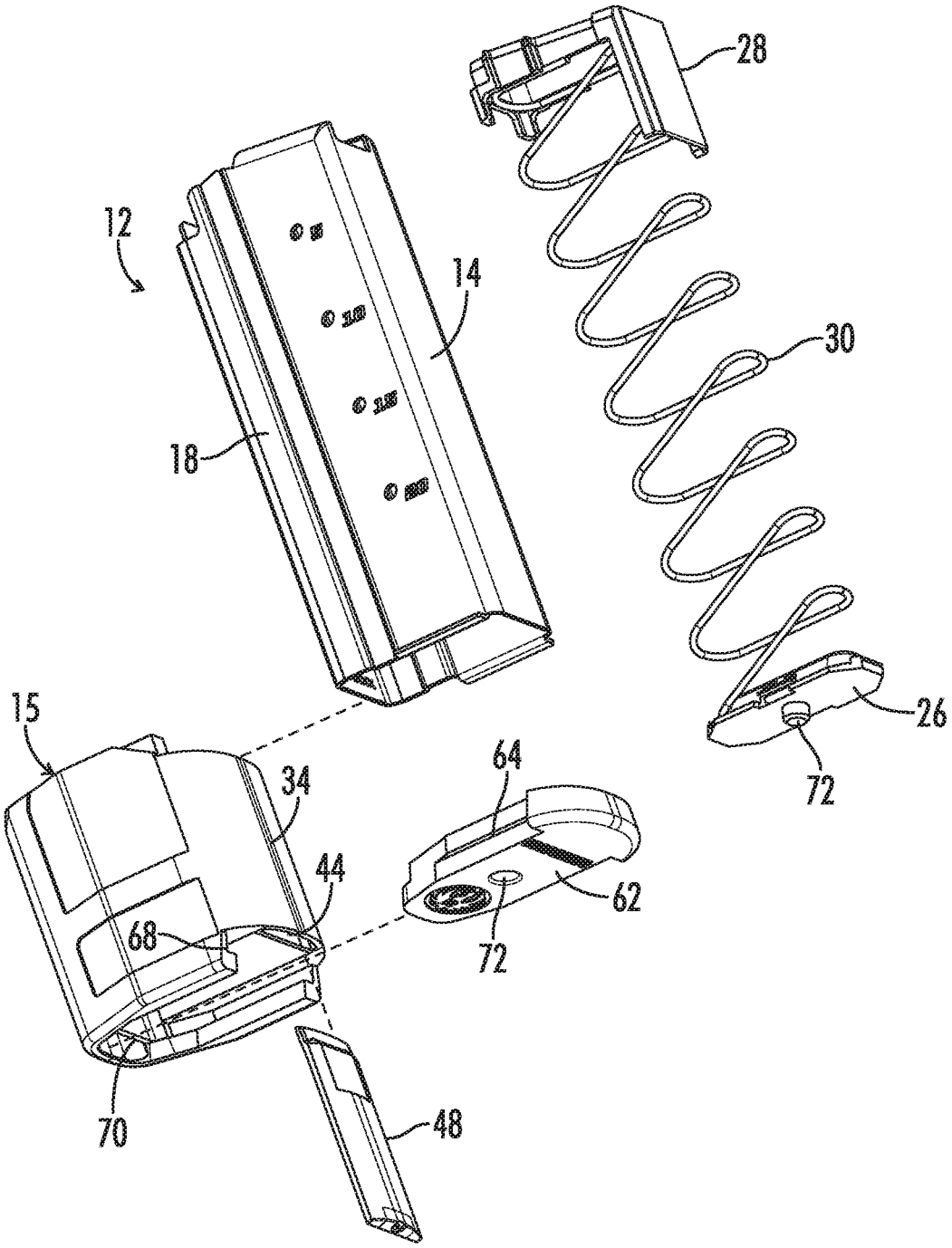
FIG. 10 is a lower rear left-side exploded isometric view of the objects of FIG. 1.
Figure 11:
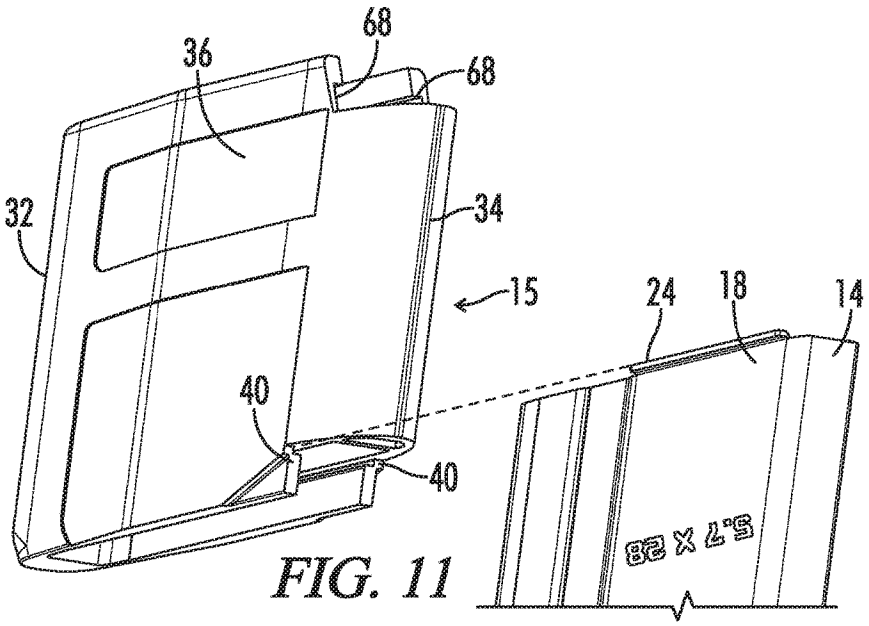
FIG. 11 is a fragmentary isometric view showing the extension body of the magazine extension of FIG. 1 being installed on the open bottom end of the magazine tube shown in FIG. 1.

The extension body 15 can have open upper and lower ends. In one embodiment, the upper end includes a pair of grooves 40 formed in opposing interior surfaces of the sidewalls 36. The grooves 40 are sized to slidingly receive the flanges 24 of the magazine tube 12. A rear edge of the open upper end of the extension body 15 is open to receive the flanges 24 into the grooves 40, as shown in FIGS. 9-11. In other embodiments, the bottom end of the magazine tube 12 can have flanges 24 on the sides and the front edge. In such embodiments, a third groove sized to slidingly receive a forward flange of the magazine tube (not shown) can be formed in the forward wall 16 of the extension body 15. In still yet other embodiments, the bottom end of the magazine tube 12 can have flanges 24 on the sides and the rear edge, such that the extension body 15 is slid into engagement from the rear and has an open front edge. In the embodiment shown, the extension body 15 is installed on the magazine tube 12 prior to insertion of the follower 28, magazine spring 30, and lock plate 26. This prevents these internal components from interfering with sliding the extension body 15 over the bottom open end of the magazine tube 12.

It should also be noted that some box-type magazine tubes not depicted herein have flanges which extend laterally inward from the sidewalls, rather than outward from the sidewalls as depicted herein. Magazine extensions configured to be slidably coupled with magazine tubes having inwardly extending flanges are specifically contemplated herein and are within the scope of the present invention. Accordingly, in some embodiments, a magazine extension 10 constructed in accordance with the present invention can have grooves 40 formed on opposing exterior surfaces of the sidewalls 36. As with prior embodiments, such grooves 40 can be sized to slidingly receive the inwardly extending flanges of the magazine tube.

Figure 5:
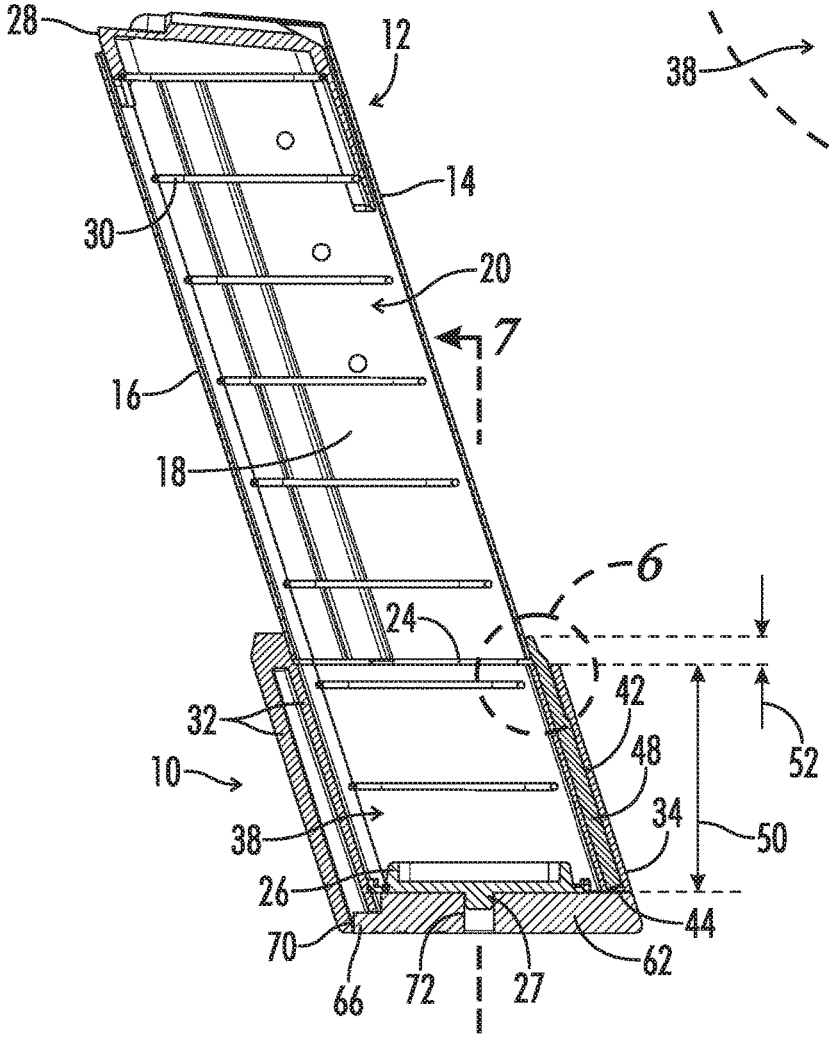
FIG. 5 is a longitudinal sectional isometric view of the objects of FIG. 1.
Figure 6:
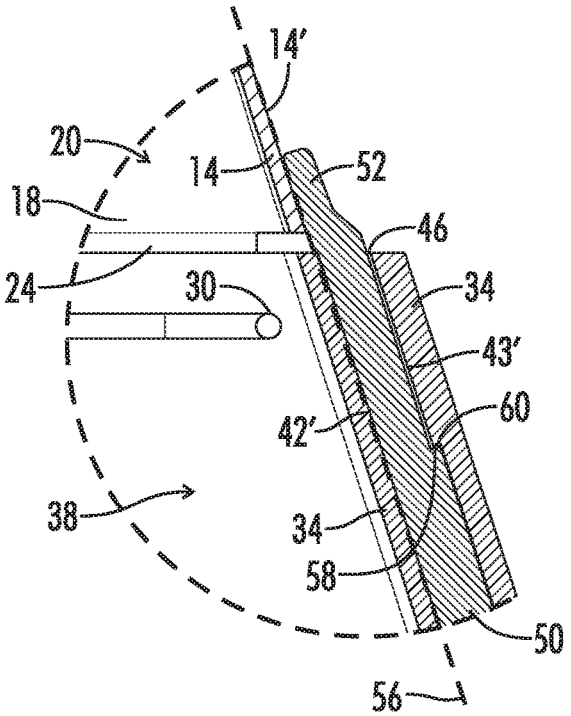
FIG. 6 is a magnified detail view of the objects of FIG. 5 at location 6.

Referring now to FIGS. 5-6, a locking or retaining member 48 is removably receivable in a passage 42 defined through the extension body 15 to secure or lock the extension body 15 to the magazine tube 12. The retaining member 48 is depicted as a generally thin, elongated wedge member having a trunk portion 50 and a tip portion 52. However, it is to be understood that the precise shape of the retaining member 48 can be varied from that of the locking wedge member depicted in the figures and remain within the scope of the invention. For example, in some embodiments, the retaining member 48 can be a pin, rod, shaft, blade, or other substantially rigid elongated member. In some embodiments, the retaining member 48 can have a cross section normal to a longitudinal axis of the retaining member 48 which is substantially uniform along the length of the member 48. In other embodiments, the retaining member 48 can have a cross section normal to a longitudinal axis of the retaining member 48 which varies at one or more locations along the length of the member 48.

The passage 42 is spaced rearwardly from the interior space 38. The passage 42 extends through the rear wall 34 from the upper end to the lower end of the extension body 15. A lower end 44 of the passage 42 is formed in the lower end of the extension body 15, and an upper end 46 is formed in the upper end of the extension body 15. When the magazine tube 12 is coupled with the extension body 15 and the retaining member 48 is received in the passage 42, the tip portion 52 protrudes out of the upper end 46 of the passage 42 and overlaps the rear wall 14 of the magazine tube 12. In this way, the tip portion 52 can contact a rear surface 14' of the rear wall 14 of the magazine tube 12 to substantially prevent sliding movement of the magazine tube 12 relative to the extension body 15. The tip portion 52 is sized and shaped (e.g., contoured) so as to be received in and protected by the magazine well of the firearm when the magazine extension 10 is installed on an ammunition magazine 12 and received in the magazine well of the firearm. This prevents the unintentional application of potentially damaging forces to the tip portion 52 of the retaining member 48. It also prevents the retaining member 48 from becoming accidentally dislodged from the passage 42 during use.

The passage 42 is depicted in the figures as a narrow slot 42 with a substantially flat forward interior surface 42' and a curved rearward interior surface 43' opposite the forward surface 42'. However, it is to be understood that the shape and size of the passage 42 can vary from that shown in the figures and remain within the scope of the present invention. For example, in some embodiments, the passage 42 can be, without limitation, circular, elliptical, rectangular, square, in lateral cross section, and non-linear or linear in longitudinal cross section. As such, the passage 42 can extend through the extension body 15 substantially parallel to the interior space 38. A forward interior surface 42' of the passage 42 can be located in substantially the same plane 56 as a rear surface 14' of the rear wall 14 of the magazine tube 12 when the extension body 15 is coupled with the magazine tube 12, as shown in FIG. 6. The upper end 46 of the passage 42 can be spaced a distance from the interior space 38 equal to or greater than the thickness of the rear wall 14 of the magazine tube 12. This ensures that the tip portion 52 of the retaining member 48 overlaps and can contact the rear surface 14' of the magazine tube 12, and thus maintains the bottom end of the magazine tube 12 seated snugly in the open upper end of the extension body 15. However, in other embodiments, the upper end 46 of the passage 42 can be spaced a distance from the interior space 38 less than the thickness of the rear wall 14 of the magazine tube 12.

The retaining member 48 can be shaped and sized to frictionally engage the passage 42 when the retaining member 48 is received in the passage 42. Accordingly, in some embodiments, the bottom end of the trunk portion 50 can be larger in at least one dimension than an upper end of the trunk portion 50. For example, as shown in FIGS. 5-6, the bottom end of the trunk portion 50 is thicker than the upper end of the trunk portion 50. In some embodiments, the retaining member 48 can have a taper between the bottom and upper ends of the trunk portion 50. In some embodiments, the retaining member 48 can taper from the bottom end of the trunk portion 50 to the tip portion 52. Additionally, the tip portion 52 can be smaller in at least one dimension than the trunk portion 50. For example, the tip portion 52 can be thinned and contoured as shown in FIGS. 1, 6, and 9-10 so as to maximize its strength and substantially prevent the retaining member 48 from interfering with insertion of a magazine tube 12 to which the extension 10 is coupled into the magazine well of the firearm.

The passage 42 can also be shaped and sized to frictionally engage and thereby retain the retaining member 48 in the passage 42 when the retaining member 48 is received in the passage 42. Accordingly, in some embodiments, the upper end 46 of the passage 42 can be smaller in at least one dimension than the lower end 44. For example, as shown in FIGS. 5-6, the upper end 46 of the passage 42 can be narrower than the lower end 44. In some embodiments, the passage 42 can have a taper between its lower and upper ends 44, 46. In some embodiments, the passage 42 can taper from its lower end 44 to its upper end 46. In other embodiments, the passage 42 can have a uniform cross section along its length from the lower end 44 to the upper end 46. In such embodiments, it can be desirable to pair the passage 42 with a retaining member 48 having a non-uniform cross section as described above in order to ensure strong frictional engagement between the retaining member 48 and the passage 42. In other embodiments, it can be desirable to form the passage 42 and retaining member 48 such that one does not frictionally engage the other so that the retaining member 48 can move more easily into and out of the passage 42 when desired by a user.

The passage 42 and retaining member 48 can also be shaped and sized so that the retaining member 48 is only receivable in the passage 42 through the lower end 44 and is not removable from the passage 42 through the upper end 46. For example, the lower end 44 of the passage 42 can be larger than the tip portion 52 of the retaining member 48 to permit insertion and seating of the retaining member 48 in the passage 42 through the lower end 44. Conversely, the upper end 46 of the passage 42 can be smaller in at least one dimension than the trunk portion 50 of the retaining member 48 to discourage insertion of the retaining member 48 into the upper end 46 and prevent removal of the retaining member 48 from the passage 42 through the upper end 46. This arrangement advantageously precludes the retaining member 42 from inadvertently falling out of or exiting the upper end of the passage 42 during assembly and use. It also facilitates disassembly of the magazine extension by requiring only that a user apply finger pressure to the tip portion 52 of the retaining member 48 in order to slide the retaining member 48 back out of the passage 42 through the lower end 44.

The magazine extension 10 can further include a positive stop system to prevent the retaining member 48 from protruding more than a predetermined distance out of the upper end 46 of the passage 42. As best shown in FIG. 6, a positive stop system can include a shelf 58 formed on a surface of the trunk portion 50 of the retaining member 48, and a corresponding overhang or protrusion 60 formed on an opposing interior surface of the passage 42. The shelf 58 and protrusion 60 are sized and shaped so that the protrusion 60 closely overhangs the shelf 58 when the retaining member 48 is received in the passage 42. When a force is applied the retaining member 48 that would otherwise move the retaining member 48 more than a predetermined distance further into the passage 42, the shelf 58 butts against and engages the protrusion 60 to limit movement of the retaining member 48 within the passage 42. This engagement between the shelf 58 and the protrusion 60 also prevents the retaining member 48 from exiting the upper end 46 of the passage 42. The positive stop system can be formed in the magazine extension 10 at virtually any position along the length of the passage 42 and retaining member 48.

The trunk portion 50 of the retaining member 48 can be completely enclosed in the passage 42 by the rear wall 34 of the extension body 15. As such, the rear wall 34 surrounds the trunk portion 50 of the retaining member 42 on all sides when the retaining member 48 is received in the passage 42. This configuration solidly anchors the trunk portion 50 in the rear wall 34 of the extension body 15 and stabilizes the tip portion 52 against the rear wall 14 of the magazine tube 12 when forces commonly encountered during use of a firearm are applied to either the magazine tube 12 or the extension body 15. Completely enclosing the retaining member 42 in the rear wall 34 also prevents entry into the passage 42 of particulate matter such as dust and dirt which could clog or obstruct the passage 42 and prevent insertion or removal of the retaining member 48 during assembly or disassembly of the magazine extension 10.

Referring again to FIGS. 1-10, the magazine extension 10 further includes a base plate member 62. The base plate 62 is removably receivable in the open lower end of the extension body 15 to releasably secure the retaining member 48 in the passage 42 and the follower 28, spring 30, and lock plate 26 in the interior spaces 20, 38. In one embodiment, the base plate 62 includes a pair of outwardly extending ridges 64 and a forwardly projecting ledge 66. The ridges 64 extend laterally outward from opposing lengthwise sides of the base plate 62. The ledge 66 extends forwardly from a forward end of the base plate 62. The open lower end of the extension body 15 includes a pair of channels 68 formed in opposing surfaces of the sidewalls 36, and a recess 70 formed in the forward wall 32. The channels 68 are sized to slidingly receive the ridges 64 of the base plate 62. The recess 70 is sized to slidingly receive the ledge 66 of the base plate 62. A rear edge of the lower end of the extension body 15 is open to receive the ridges 64 into the channels 68 and the ledge 66 into the recess 70, as in FIGS. 5, 7, 10 and 13. The base plate 62 obstructs or closes the lower end 44 of the passage 42 and thereby prevents the retaining member 48 from exiting the lower end 44 of the passage 42 when the retaining member 48 is received in the passage 42, the ridges 64 are received in the channels 68, and the ledge 66 is received in the recess 70. At the same time, the base plate 62 also obstructs or closes the lower end of the interior space 38 of the extension body 15. Accordingly, when releasably coupled with the extension body 15 as described, the base plate 62 closes off and fills the open lower end of the extension body 15 and provides the magazine extension 10 with a smooth exterior surface.

Figure 7:
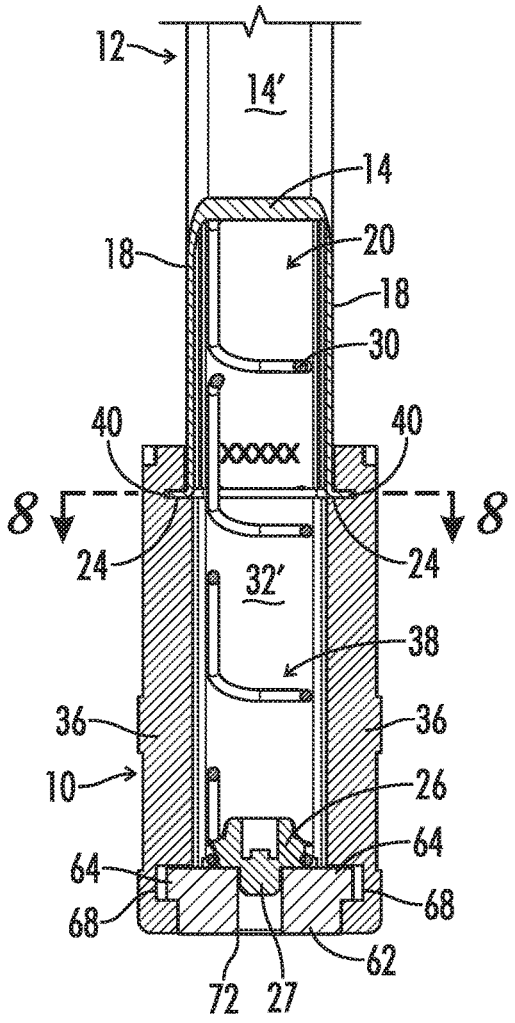
FIG. 7 is a fragmentary rear sectional isometric view of the objects of FIG. 1 taken substantially along line 7-7 of FIG. 5.
Figure 8:
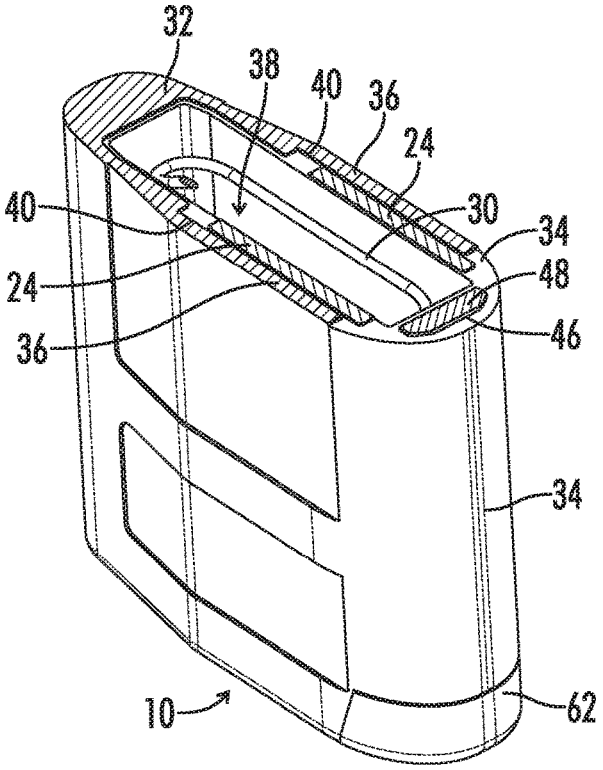
FIG. 8 is a sectional isometric view of the objects of FIG. 1 taken substantially along line 8-8 of FIG. 7.

Referring to FIGS. 5 and 7, a hole 72 is defined through the base plate 62. The hole 72 extends through the base plate 62 from an upper surface to a lower surface. The hole 72 can extend through the base plate 62 substantially vertically or at an angle from vertical. The hole 72 is sized and shaped to receive the protrusion 27 extending downwardly from the bottom surface of the spring seat or lock plate 26. The protrusion 27 is removably receivable in the hole 72 to releasably secure the base plate 62 to the extension body 15 when the ridges 64 and the ledge 66 are received in the channels 68 and the recess 70, respectively, and the follower 28, magazine spring 30, and lock plate 26 are received in the appropriate interior spaces 20, 38 of the magazine tube 12 and extension body 15, respectively.

It is to be noted that the base plate 62 is designed to function with any spring seat or lock plate having a protrusion or knob extending from a bottom surface thereof. As such, a suitable lock plate can be a native component of the ammunition magazine with which the magazine extension 10 disclosed herein is intended to be coupled. However, it is recognized that not every ammunition magazine includes a spring seat or lock plate having such a protrusion. Accordingly, in some embodiments, the magazine extension 10 can include a lock plate 26 sized and shaped to be received in the magazine extension and having a protrusion or knob extending from a bottom surface thereof. In additional embodiments, the magazine extension 10 can include a lock plate 26 substantially as shown and described herein.

Figure 12:
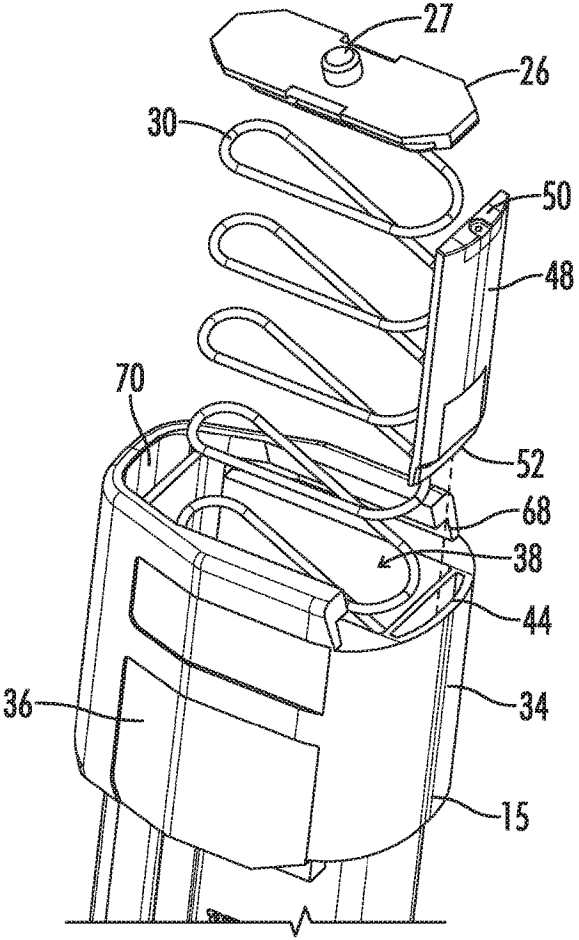
FIG. 12 is a fragmentary isometric view showing a retaining member being inserted into the lower end of a passage formed in the rear wall of the extension body of FIG. 11, and a follower, magazine spring, and lock plate being inserted into the magazine tube through the open lower end of the extension body.
Figure 13:
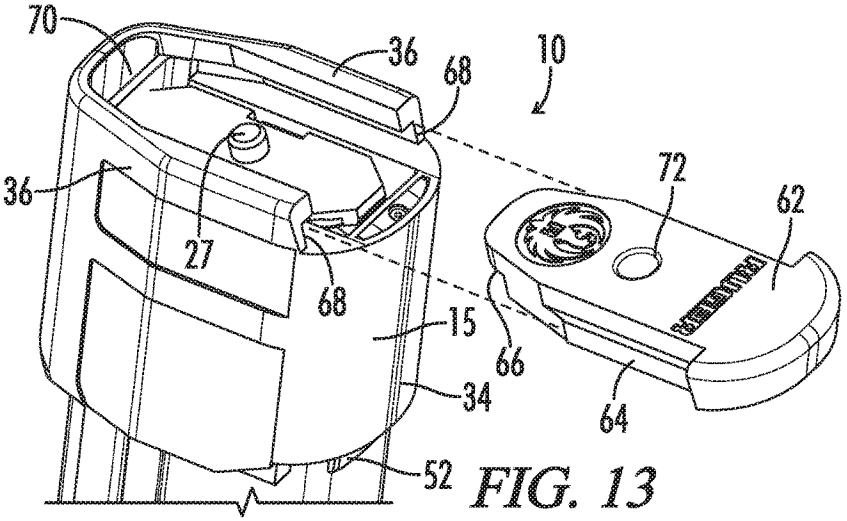
FIG. 13 is a fragmentary isometric view showing the follower, magazine spring, and lock plate installed, and the base plate of the magazine extension of FIG. 1 being inserted into the open bottom end of the magazine extension body.

FIGS. 11-13 depict installation and assemble of the magazine extension 10 on a magazine tube 12 for an ammunition magazine, as well as a method for increasing the capacity of an ammunition magazine for a firearm. The objects presented in the drawings are depicted in an upside-down orientation because it is believed that installation and assembly of the depicted components is most easily and quickly achieved in this orientation. However, those of skill in the art will recognize that installation and assembly can also be achieved by assembling the components in a different orientation, including, for example, an upright orientation as depicted in FIGS. 9-10.

The open bottom end of the magazine tube 12 is releasably coupled with the open upper end of extension body 15 by sliding the flanges 24 of the magazine tube 12 into the grooves 40 of the open upper end of the extension body 15. The forward wall 16 of the magazine tube 12 should butt against the forward wall 32 of the extension body 15 when the tube 12 is properly received and seated in the extension body 15.

The tip portion 52 of the retaining member 48 can be inserted at least partially into the lower end 44 of the passage 42 before or after the extension body 15 is coupled with the magazine tube 12. If the retaining member 48 is inserted into the passage 42 before the extension body 15 is coupled with the magazine tube 12, the retaining member 48 should not be inserted so far into the passage 42 that the tip portion 52 protrudes out of the upper end 46. This prevents the retaining member 48 from interfering with the magazine tube 12 being properly received or seated in the extension body 15. Alternatively, if the retaining member 48 is inserted into the passage 42 after the extension body 15 is coupled with the magazine tube 12, the retaining member 48 should be fully installed in the passage 42 so that the tip portion 52 protrudes out of the upper end 46 of the passage 42 and overlaps the rear wall 14 of the magazine tube 12 as described above. This prevents the magazine tube 12 from sliding out of or otherwise becoming unseated from the open upper end of the extension body 15 during subsequent assembly and use.

Once the magazine tube 12 is received in the open upper end of the extension body 15, the follower 28, magazine spring 30, and lock plate 26 can be inserted through the open bottom end of the extension body 15 as shown in FIG. 12. The follower 28 should be received in the interior space 20 of the magazine tube 12 against the feed lips 20, with one end of the magazine spring 30 pressing against the follower 28. The lock plate 26 is placed adjacent the other end of the magazine spring 30 opposite the follower 28.

With the retaining member 48 received in the passage 42 and the follower 28, magazine spring 30, and lock plate 26 received inside the magazine tube 12 and extension body 15, light pressure is applied to the lock plate 26 to compress the magazine spring 30 and lower the lock plate 26 into the interior space 38 of the extension body 15. The base member 62 is then slid into the mouth of the open bottom end of the extension body 15 over the lock plate 26 and orthogonal to the spring 30 so that the ridges 64 and ledge 66 of the base plate 62 are received in the channels 68 and recess 70 of the extension body, respectively, as indicated in FIG. 13. When the base plate 62 is so received to the extension body 15, the magazine spring 30 biases the protrusion 27 of the lock plate 26 into the hole 72 of the base plate 62 to secure the base plate 62 to the extension body 15 and thus lock the magazine extension 10 onto the magazine tube, thereby forming an ammunition magazine for a firearm with an increased ammunition capacity.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MAGAZINE EXTENSION FOR A FIREARM, it is not intended that such references be construed as limitations upon the scope of this invention except as set forth in the following claims.

What is claimed is:

1. A magazine extension, comprising:

an extension body defining an open upper end configured to be slidably coupled with an open bottom end of a magazine tube for an ammunition magazine;

a retaining member removably receivable in the extension body to limit sliding movement of the magazine tube relative to the extension body when the magazine tube is coupled with the extension body; and a base plate slidably couplable with an open lower end of the extension body to prevent the retaining member from exiting a lower end of the extension body when the retaining member is received in the extension body;

wherein the base plate defines a hole in which a protrusion extending from a lock plate for the ammunition magazine is receivable to secure the base plate to the extension body.

2. The magazine extension of claim 1, wherein:

the retaining member is removably receivable through a wall of the extension body; and the base plate prevents the retaining member from exiting a lower end of the wall of the extension body when the retaining member is received through the wall of the extension body.

3. The magazine extension of claim 2, wherein the wall of the extension body through which the retaining member is removably receivable is a rear wall of the extension body.

4. The magazine extension of claim 3, wherein the rear wall of the extension body surrounds at least a portion of the retaining member on all sides when the retaining member is received through the rear wall of the extension body.

5. The magazine extension of claim 3, wherein the retaining member overlaps a rear wall of the magazine tube to limit sliding movement of the magazine tube relative to the extension body when the magazine tube is coupled with the extension body and the retaining member is received through the rear wall of the extension body.

6. The magazine extension of claim 5, wherein the retaining member releasably secures the extension body to the magazine tube when the magazine tube is coupled with the extension body and the retaining member is received through the rear wall of the extension body.

7. The magazine extension of claim 6, wherein the rear wall of the extension body defines a passage in which the retaining member is removably receivable.

8. The magazine extension of claim 7, wherein the retaining member protrudes out of an upper end of the passage when the retaining member is received in the passage.

9. The magazine extension of claim 7, wherein the base plate releasably secures the retaining member in the passage when the retaining member is received in the passage and the base plate is coupled with the extension body.

10. The magazine extension of claim 9, wherein the base plate obstructs a lower end of the passage and prevents the retaining member from exiting the lower end of the passage when the retaining member is received in the passage and the base plate is coupled with the extension body.

11. The magazine extension of claim 7, wherein:

the passage has a lower end and an upper end;

the retaining member is only receivable in the passage through the lower end; and the retaining member is not removable from the passage through the upper end.

12. The magazine extension of claim 11, wherein:

the upper end of the passage is narrower than the lower end; or an upper portion of the retaining member is thinner than a lower portion of the retaining member.

13. The magazine extension of claim 7, wherein the base plate releasably secures the retaining member in the passage by obstructing a lower end of the passage and preventing the retaining member from exiting the lower end of the passage when the retaining member is received in the passage and the base plate is coupled with the extension body.

14. A magazine extension, comprising:

an extension body defining an open upper end configured to be slidably coupled with an open bottom end of a magazine tube for an ammunition magazine;

a retaining member configured to be removably received in the extension body to limit sliding movement of the magazine tube relative to the extension body when the magazine tube is coupled with the extension body;

a base plate configured to be slidably coupled with an open lower end of the extension body to prevent the retaining member from exiting a lower end of the extension body when the retaining member is received in the extension body; and a hole defined in the base plate;

wherein a protrusion extending from a lock plate for the ammunition magazine is receivable in the hole to secure the base plate to the extension body.

15. The magazine extension of claim 14, wherein:

the retaining member is removably receivable through a rear wall of the extension body; and the base plate prevents the retaining member from exiting a lower end of the rear wall of the extension body.

16. The magazine extension of claim 15, wherein the retaining member limits sliding movement of the magazine tube relative to the extension body by overlapping a rear wall of the magazine tube when the magazine tube is coupled with the extension body and the retaining member is received through the rear wall of the extension body.

17. The magazine extension of claim 16, wherein the retaining member releasably secures the extension body to the magazine tube when the magazine tube is coupled with the extension body and the retaining member is received through the rear wall of the extension body.

18. The magazine extension of claim 15, wherein the rear wall of the extension body defines a passage in which the retaining member is removably receivable.

19. The magazine extension of claim 18, wherein the retaining member protrudes out of an upper end of the passage when the retaining member is received in the passage.

20. A magazine extension, consisting of:

an extension body defining an open upper end configured to be slidably coupled with an open bottom end of a magazine tube for an ammunition magazine;

a retaining member configured to be removably receivable in the extension body to secure the extension body to the magazine tube by limiting sliding movement of the magazine tube relative to the extension body when the magazine tube is coupled with the extension body;

a base plate configured to be slidably coupled with an open lower end of the extension body to secure the retaining member in the extension body by preventing the retaining member from exiting a lower end of the extension body when the retaining member is received in the extension body;

wherein the base plate defines a hole in which a protrusion extending from a lock plate for the ammunition magazine is receivable to secure the base plate to the extension body.

* * * * *